US008391527B2

(12) United States Patent
Feucht et al.

(10) Patent No.: US 8,391,527 B2
(45) Date of Patent: Mar. 5, 2013

(54) IN THE EAR HEARING DEVICE WITH A VALVE FORMED WITH AN ELECTROACTIVE MATERIAL HAVING A CHANGEABLE VOLUME AND METHOD OF OPERATING THE HEARING DEVICE

(75) Inventors: Hans-Dieter Feucht, Renningen (DE); Frank Naumann, Erlangen (DE); Uwe Rass, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 252 days.

(21) Appl. No.: 12/844,033

(22) Filed: Jul. 27, 2010

(65) Prior Publication Data

US 2011/0019852 A1 Jan. 27, 2011

(30) Foreign Application Priority Data

Jul. 27, 2009 (DE) ..... 10 2009 034 826

(51) Int. Cl.
*H04R 25/00* (2006.01)

(52) U.S. Cl. ..... 381/328; 381/57; 381/190

(58) Field of Classification Search ..... 381/328
See application file for complete search history.

(56) References Cited

U.S. PATENT DOCUMENTS 5,241,991 A * 9/1993 Iorio et al. ..... 137/807
6,549,635 B1 * 4/2003 Gebert ..... 381/324
7,320,457 B2 1/2008 Heim et al.
2004/0232807 A1 11/2004 Pelrine et al.
2007/0020784 A1 1/2007 Timans
2009/0065067 A1 * 3/2009 Bushman et al. ..... 137/217
2010/0014696 A1 1/2010 Boschung et al.

FOREIGN PATENT DOCUMENTS

DE 19942707 A1 3/2001
WO 2007005489 A2 1/2007
WO 2007054589 A2 5/2007

OTHER PUBLICATIONS

Yoseph Bar-Cohen: "Electroactive Polymer (EAP) Actuators as Artificial Muscles—Reality, Potential and Challenges", Book, Pasedena, California.
Phonak: "Acoustically Optimized Venting (AOV)", Phonak Life Is On, Apr. 2, 2008, pp. 1-3, Stäfa, Switzerland.
Schrüfer, Elmar: "Elektrische Meβtechnik", 1. Auflage, München, Hanser-Verlag, 1983, p. 153—Statement of Relevance.

* cited by examiner

*Primary Examiner* — Christopher Uhlir
(74) *Attorney, Agent, or Firm* — Laurence A. Greenberg; Werner H. Stemer; Ralph E. Locher

(57) ABSTRACT

For particularly good adaptation to a given hearing situation, an in-the-ear hearing device which has a housing with a channel in the housing that is designed as a through-opening for sound and air between the interior of the ear and the environment outside the ear, the channel is provided with a structural element for changing the size of the through-opening at at least one position. The structural element is a valve formed with electroactive material and the size of the through-opening is adjusted by application of a voltage to the valve.

8 Claims, 2 Drawing Sheets

IN THE EAR HEARING DEVICE WITH A VALVE FORMED WITH AN ELECTROACTIVE MATERIAL HAVING A CHANGEABLE VOLUME AND METHOD OF OPERATING THE HEARING DEVICE

CROSS-REFERENCE TO RELATED APPLICATION

This application claims the priority, under 35 U.S.C. §119, of German application DE 10 2009 034 826.3, filed Jul. 27, 2009; the prior application is herewith incorporated by reference in its entirety.

BACKGROUND OF THE INVENTION

Field of the Invention

The invention relates to an in-the-ear hearing aid having a housing and a channel in the housing formed as a through-opening for sound and air between the interior of the ear and the environment outside the ear. The invention also pertains to a method for automatically regulating the size of a through-opening of a hearing aid.

State of the art in-the-ear (ITE) hearing aids usually have a channel, also called a vent, forming a through-opening between the interior of the ear and the environment outside the ear. The vent helps solve the problem of occlusion in which sounds, for example the voice of the person wearing the hearing aid or chewing noises, are trapped in the auditory canal and are fed back to the ear drum, as a result of which they appear unnaturally loud to the person wearing the hearing aid. These effects can be so unpleasant that many wearers completely abandon the use of a hearing aid. In order to reduce the risk of occlusion, it is known to arrange through-openings on the hearing aid. However, this often reduces the attainable acoustic amplification and thus limits the performance of the hearing aid. Too large a through-opening can also be to the detriment of the optimal overall size of the hearing aid. Hearing aids for individual ears are often subject to serious space limitations, e.g. since a small hearing aid is often unable to provide a large through-opening while at the same time providing enough space for all the necessary electronic components. Another advantage of the vent is that it can be used for ventilation of the interior of the ear and for moisture exchange.

In state of the art hearing aids the size of the through-opening is fixed during the manufacture of the hearing aid. The through-openings usually have a diameter of between 1 mm and 3 mm. The diameter is always a compromise between the necessary amplification and wearing comfort (occlusion and ventilation). The size of the through-opening cannot be subsequently increased, and it can be made smaller only with great difficulty, for example with the aid of reducing pieces.

SUMMARY OF THE INVENTION

It is accordingly an object of the invention to provide a hearing device and a method which overcome the above-mentioned disadvantages of the heretofore-known devices and methods of this general type and which provides for a hearing aid that, in terms of amplification and wearing comfort, is at all times optimally adapted to a given hearing situation, and also provides for a method for such adaptation.

With the foregoing and other objects in view there is provided, in accordance with the invention, an in-the-ear hearing device, such as a hearing aid, comprising:

a housing to be worn in an ear of a user;

the housing having a channel formed therein as a through-opening for sound and air between an interior of the ear and an environment outside the ear;

a valve formed, at least partially, of electroactive material, the valve being disposed to change a size of the through-opening in at least one position thereof by application of a voltage.

In other words, the objects of the invention are achieved by an in-the-ear (ITE) hearing device with a through-opening that is automatically controlled in terms of the size of the through-opening.

In the in-the-ear hearing device according to the invention, with a housing and with a channel which is arranged in the housing and which is designed as a through-opening for sound and air between the interior of the ear and the environment outside the ear, the channel has a structural element, in particular a valve or valve-like element, which is designed to change the size of the through-opening at least one position. The hearing device according to the invention can, if so required, change the size or the diameter of the through-opening such that, in a manner that is adapted to the hearing situation, good wearing comfort and also optimal amplification are possible. The hearing device, which is particularly suited as a hearing aid, can adapt flexibly to changing environmental influences. The problems of occlusion and of ventilation and also the problems of too weak an amplification are solved.

According to one embodiment of the invention, the valve is designed to change the size of the through-opening by application of a voltage. This can be done simply and inexpensively and does not require additional space.

For a particularly simple and quick change in the size of the through-opening, the valve is advantageously formed at least partially from a material which is designed for a triggered change in its volume by at least 10%. Such a material can be arranged in the through-opening and can be triggered to change its volume. In this way, the through-opening can be made bigger or smaller. Ideally, the material is designed for a change of volume of at least 25%.

According to one embodiment of the invention, the valve is made at least partially from an electroactive material, in particular a polymer. Electroactive materials or polymers can be caused to change their volume by application of a voltage. Examples of such materials are ionic metal/polymer composites, ionic gels and conductive polymers. Because of their freedom from harmful substances, polymers are very suitable, in particular dry systems in which undesired phase separation and/or outward diffusion of active components or of solvent or softeners are excluded. Electroactive polymers are known in general and are used, for example, as sensors or actuators.

According to another embodiment of the invention, the valve is composed of several layers of the electroactive polymer. A particularly extensive change of size can be achieved in this way. The valve can also be composed of a matrix-like structure of electroactive polymer or of a round structure of electroactive polymer.

With the above and other objects in view there is also provided, in accordance with the invention, a method of operating an in-the-ear hearing device. The novel method comprises:

providing an in-the-ear hearing device having a housing and a channel in the housing formed as a through-opening for sound and air between an interior of the ear and an environment outside the ear;

providing a valve that is at least partially formed of electroactive material and that is configured to change a size of the through-opening, at least in one location thereof, when a voltage is applied to the valve; and automatically regulating the size of the through-opening by:

registering a hearing situation that requires an acoustic amplification or attenuation; and using the valve to adapt the size of the through-opening to the hearing situation.

In other words, the method according to the invention for automatically regulating the size of the through-opening in the hearing aid comprises the steps of registering a hearing situation which requires an acoustic amplification or attenuation, and using the valve or valve-like element to adapt the size of the through-opening to the hearing situation.

Other features which are considered as characteristic for the invention are set forth in the appended claims.

Although the invention is illustrated and described herein as embodied in a hearing aid and method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In principle, the main components of hearing devices, such as hearing aids, are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electro-mechanical transducer, e.g. a bone conduction earpiece. The amplifier is usually integrated into a signal-processing unit. By way of a hearing device, an input signal is typically received and converted to an audio signal, is then processed in a signal-processing unit and amplified and then output.

Figure 1:
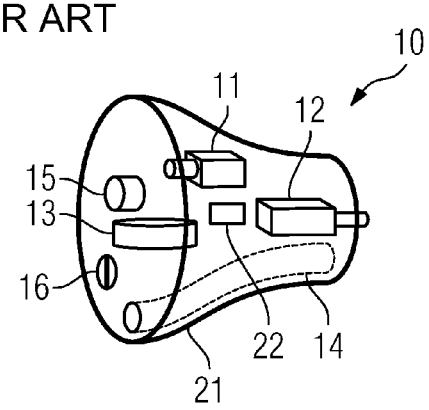
FIG. 1 PRIOR ART
FIG. 1 is a schematic, perspective diagram of a prior art hearing device formed with a channel.

Referring now to the figures of the drawing in detail and first, particularly, to FIG. 1 thereof, there is shown the configuration of a conventional in-the-ear (ITE) hearing aid 10. The hearing aid has a microphone 11 as input transducer, a receiver 12 as output transducer, and also a signal-processing unit 22 with amplifier. It is also provided with a battery 13 for supplying energy and voltage, a loudspeaker control 15 and, in more recent devices, a program interface 16. The hearing aid additionally has a channel (vent) 14, which forms a through-opening between the interior of the ear and the environment outside the ear.

A hearing aid according to the invention now additionally has a valve or valve-like element which is arranged in the channel 14 and which is designed to change the size of the through-opening; complete closure of the through-opening is also possible. For this purpose, the valve is preferably made at least partially from a material which, when triggered, can cause a change in its volume. In particular, this kind of triggering can entail applying a voltage to the material or modifying an applied voltage. Materials that are caused to change volume by a voltage are referred to as electroactive materials. Examples of electroactive materials are ionic metal/polymer composites, ionic gels and conductive polymers. Electroactive conductive polymers are suitable in particular for use as a valve in the hearing aid, and of these in particular dry systems. Conductive polymers can achieve out-of-plane volume changes of up to about 30%. Electroactive polymers can in turn be divided into ionic or electronic electroactive polymers. Examples of frequently used systems are based on polypyrrole and/or polythiophene polymers and copolymers. For actuating and/or regulating the valve, and therefore the change in the through-opening, it is also possible, for example, to use the signal-processing unit or an additional controlling and regulating unit connected to the latter. Here, the term regulating refers to the closed-loop control of the system.

Figure 2:
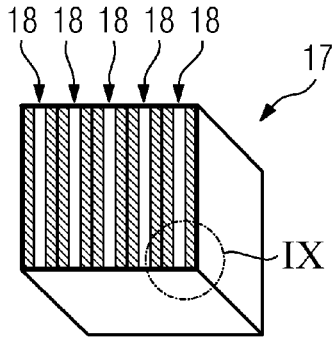
FIG. 2 shows a view of a valve design with several chambers.
Figure 9:
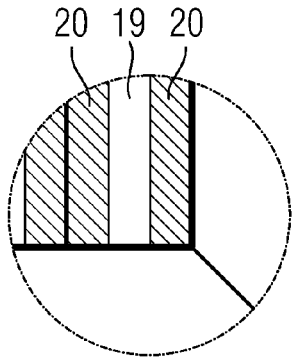
FIG. 9 shows an enlarged view of the detail IX in FIG. 2, showing a chamber.

The general design of a valve 17 in a hearing aid 10 according to the invention is shown in FIG. 2 and in an enlarged view in FIG. 9, but the voltage-conducting components are not depicted. The valve has, for example, several chambers 18, e.g. five chambers, it also being possible for there to be more or fewer chambers. By means of a multi-layer design, it is possible to achieve a substantial change in cross section with just a small expansion in volume. An air gap 19 is arranged in each chamber 18, between two polymer layers 20. The extent of the chamber can, when necessary, be changed by expansion or contraction of the polymer layers. Electrodes for applying a voltage are also applied to the polymer layers. In addition, it may be necessary to apply a protective layer to the polymer layer, in particular to the rear surfaces, in order to prevent penetration of water, vapor or other damaging substances.

If, by way of example, a polymer is used that can change its volume by 30%, it is possible, according to the following calculation, for a size adaptation to take place corresponding approximately to an opening diameter of 1 mm to 3 mm and vice versa. The height of the valve is, for example, 5 mm; there are five chambers present, each with a width of 1.2 mm. At their smallest extent, the polymer layers are each 0.45 mm. In this state, the air gap is approximately 0.3 mm. This corresponds to a free cross section of 7.5 $mm^2$, which corresponds approximately to an opening diameter of 3 mm (7.06 $mm^2$). With a 30% expansion of each of the polymer layers to 0.59 mm, an air gap of 0.3 mm remains in each case. This corresponds to a free cross section of 0.75 $mm^2$, which closely resembles an opening diameter of 1 mm (0.78 $mm^2$).

Figure 3:
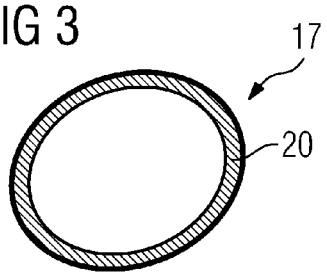
FIG. 3 shows another view of a valve design with a round structure.
Figure 4:
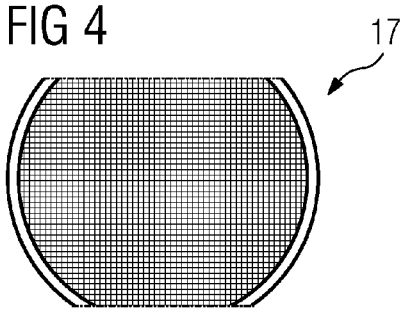
FIG. 4 shows another view of a valve design with a lattice-like structure.
Figure 5:
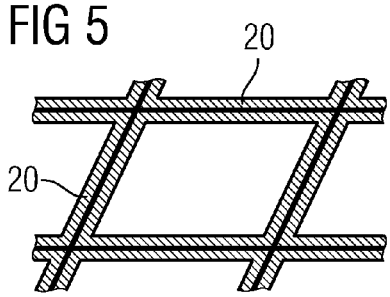
FIG. 5 is an enlarged view of the lattice-like structure according to FIG. 4.

FIGS. 3 to 5 show alternative configurations of the valve. For example, as is shown in FIG. 3, the valve can have a round configuration, with only one polymer layer being shown here along the wall of the valve. The opening diameter changes directly here when there is a change in volume of the polymer layer. In this way, a change in the opening diameter of the through-opening can also be achieved. However, in the case of a polymer with a 30% change in volume, this is less than in the case of the valve that is composed of several chambers.

FIG. 4 shows a valve with lattice-like structures. These are designed in a similar way to the chamber-like structures and have walls with polymer layers and air gaps, as is shown in an enlarged view in FIG. 5. By expansion of the polymer layers, the air gaps can be reduced and even completely closed.

Figure 6:
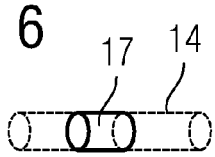
FIG. 6 is a view of an exemplary embodiment in which a valve is disposed at a predetermined location in the channel.
Figure 7:
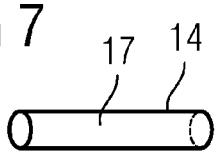
FIG. 7 is a similar view of an exemplary embodiment in which the valve is formed as an elongate valve filling the entire channel.

FIGS. 6 and 7 show examples of how a valve can be arranged inside the channel. As is shown in FIG. 6, it can be arranged at one position of the channel, for example at the center, but also at the end. However, as is shown in FIG. 7, the valve can also extend through the entire channel.

Figure 8:
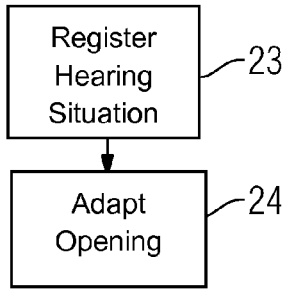
FIG. 8 shows a sequence of basic steps in the method according to the invention.

In the method according to the invention, the hearing device according to the invention can adapt automatically to the corresponding hearing situation. For this purpose, the hearing device registers a hearing situation which requires an amplification or attenuation (FIG. 8; step 23). For this purpose, for example, the signal-processing unit or an additional processing unit or a control and closed-loop control (regulating) unit can, on the basis of the incoming signals, determine the required amplification or attenuation and can compare this to a reference value, for example. If the reference value is exceeded, the signal-processing unit or the additional processing unit or the controlling and regulating unit can additionally calculate what size of through-opening is needed to bring the amplification or attenuation to zero or at least to below the reference value. This information is then used for actuating the valve 17. The valve 17 is then actuated in order to reduce or increase the size of the through-opening according to the default settings (step 24). In the case of an electroactive material or polymer, this is done by applying a voltage. For example, if more amplification is needed, i.e. the incoming signal is too quiet, the through-opening is made smaller or even completely closed by the valve. By contrast, if attenuation is needed, i.e. the incoming signal is too loud, the through-opening is increased in size by the valve.

In addition, provision can also be made for the through-opening of the channel to be modified manually by the person wearing the hearing device, for example by means of an operating element on the hearing aid.

The invention can be summarized as follows: for a particularly good adaptation to a given hearing situation, an in-the-ear hearing device or hearing aid is proposed with a housing and with a channel which is arranged in the housing and which is designed as a through-opening for sound and air between the interior of the ear and the environment outside the ear, wherein the channel has a structural element, in particular a valve, which is designed to change the size of the through-opening at least one position.

The invention claimed is:

1. An in-the-ear hearing device, comprising:

a housing to be worn in an ear of a user;

said housing having a channel formed therein as a through-opening for sound and air between an interior of the ear and an environment outside the ear;

a valve formed, at least partially, of electroactive material, said valve being disposed to change a size of said through-opening in at least one position thereof by application of a voltage;

said electroactive material having a changeable volume designed to have a controlled change of at least 10%.

2. The hearing device according to claim 1, wherein said electroactive material is an electroactive polymer.

3. The hearing device according to claim 2, wherein said electroactive polymer is configured to change the volume by application of a voltage.

4. The hearing device according to claim 2, wherein said valve is composed of a plurality of layers of the electroactive polymer.

5. The hearing device according to claim 2, wherein said valve is composed of a matrix structure of the electroactive polymer.

6. The hearing device according to claim 2, wherein said valve comprises a round structure of the electroactive polymer.

7. The hearing device according to claim 1, wherein said electroactive material is configured to change a volume by application of a voltage.

8. A method of operating an in-the-ear hearing device, the method which comprises:

providing an in-the-ear hearing device having a housing and a channel in the housing formed as a through-opening for sound and air between an interior of the ear and an environment outside the ear;

providing a valve that is at least partially formed of electroactive material and that is configured to change a size of the through-opening, at least in one location thereof, when a voltage is applied to the valve, wherein the electroactive material has a changeable volume designed to have a controlled change of at least 10%; and automatically regulating the size of the through-opening by:

registering a hearing situation that requires an acoustic amplification or attenuation; and using the valve to adapt the size of the through-opening to the hearing situation by changing the volume of the electroactive material.

* * * * *